US005111859A

United States Patent [19]

Tohkala et al.

[11] Patent Number: 5,111,859

[45] Date of Patent: May 12, 1992

[54] CHIPPING METHOD AND DEVICE

[75] Inventors: Antti Tohkala, Rauma; Esko Unkuri, Nakkila, both of Finland

[73] Assignee: Sunds Defibrator Rauma Woodhandling Oy, Pori, Finland

[21] Appl. No.: 692,558

[22] Filed: Apr. 29, 1991

[30] Foreign Application Priority Data

Apr. 27, 1990 [FI] Finland ..... 90 2147

[51] Int. Cl.[5] ..... B27L 11/02; B27C 1/00

[52] U.S. Cl. ..... 144/373; 144/172; 144/174

[58] Field of Search ..... 144/162 R, 172, 173, 144/174, 163, 373; 241/85, 89.3, 92, 95

[56] References Cited

U.S. PATENT DOCUMENTS 2,773,739 12/1956 Clark .
2,969,860 1/1961 Johnsa ..... 144/174
3,319,673 5/1967 Voelskow ..... 144/172
3,356,114 12/1967 Noel ..... 144/172
3,913,643 10/1975 Lambert ..... 144/172
4,972,888 11/1990 Dean ..... 144/174

FOREIGN PATENT DOCUMENTS 7509785-7 11/1978 Sweden .

*Primary Examiner*—W. Donald Bray
*Attorney, Agent, or Firm*—Burns, Doane, Swecker & Mathis

[57] ABSTRACT

Method and chipping device for cutting chips (10) from elongated pieces of wood (5) in a manner that the wood to be chipped is fed into a rotating cylinder (1) and chips are cut of the side of the piece of wood by ranges of blades formed by several blades (7) inside the cylinder surface. The wood to be chipped (5) is directed to the cylinder in a manner that the angle between the pieces of wood (5) and the ranges of blades is acute. Each piece of wood to be chipped is in contact with two or more blades (7) in different range of blades during the cutting.

5 Claims, 3 Drawing Sheets

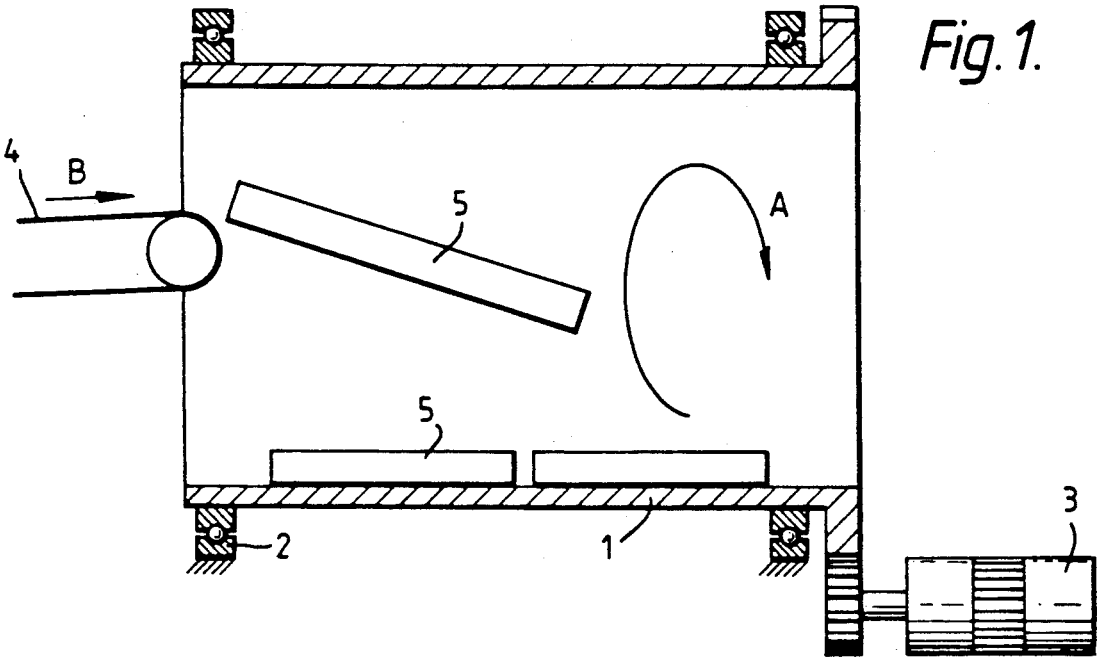
Fig. 1.
Fig. 3.
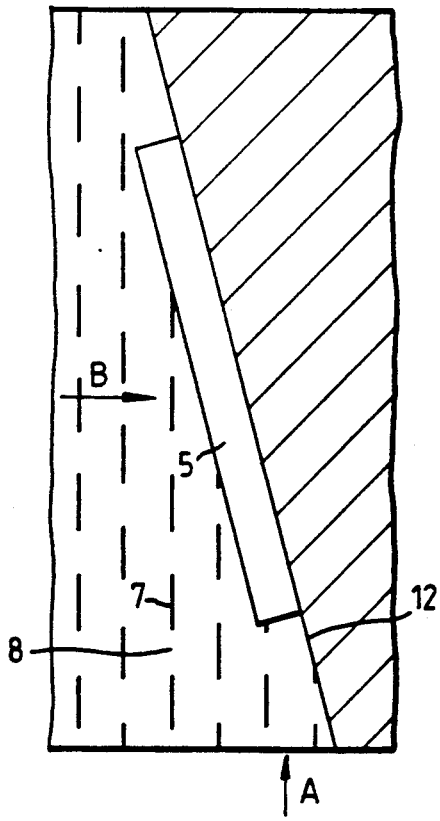

CHIPPING METHOD AND DEVICE

This invention relates to a method for cutting wood chips of elongated pieces of wood in a manner, that the wood to be chipped is fed inside of a rotating cylinder and chip pieces are cut of the side of the wood by a range of cutters formed by several cutters inside of the cylinder. This invention also relates to a chipping device, which consists of a rotating cylinder, the inside of which is equipped with ranges of cutters formed by several cutting blades, and of a stop face inside of the cylinder, which is constructed to support the sides of the elongated pieces of wood to be chipped during the cutting.

Wood chips used in chemical pulping process are usually made out of wood by a disk chipper, which cuts the chips across the grain.

When the chips are cut in parallel direction with the grain, the fiber length of chips is naturally higher.

Swedish Patent 75 09785 discloses a chipping device, whereby the cutting blades are constructed inside of the cylinder in parallel direction with the cylinder axle and the wood to be chipped is fed into the cylinder axially as well. Chips discharge of the cylinder through openings in the cylinder. The construction of the chipping blades and formation of chips is described in more detail in U.S. Pat. 2,773,789, which however relates to a device, whereby the cutting blades are outside of the cylinder.

In both of these known devices separate bodies are needed to hold the wood to be chipped in its position. In the device disclosed in the Swedish Patent 75 09785 an inconvenient piston-like construction is used, which presses the wood bundle against the inside of the cylinder. Feeding proceeds in lots, a separate wagon one by one.

The objective of the present invention is to provide a chipping device, whereby the wood to be chipped is fed into the cylinder and no separate bodies for holding the wood in its position are needed. Characteristic for the method according to this invention is, that the wood to be chipped is guided into the cylinder in a manner, that the angle between the wood pieces and range of cutting blades is acute, whereby each piece of wood to be chipped is in connection during the cutting with two or more blades in different range of cutting blades. Characteristic for the chipping device according to this invention is, that the stop face is constructed in acute angle with the range of cutters formed by cutting blades.

In the chipping device according to this invention the wood to be chipped is during the entire cutting procedure in connection with at least two cutting blades. This means, that the cutting blades hold the wood in its position thus preventing it from rotating. No separate bodies for holding the wood in its position are needed. Pieces of wood can be fed into the cylinder continuously, and there is no need for stopping the device between the feeding lots.

Figure 2:
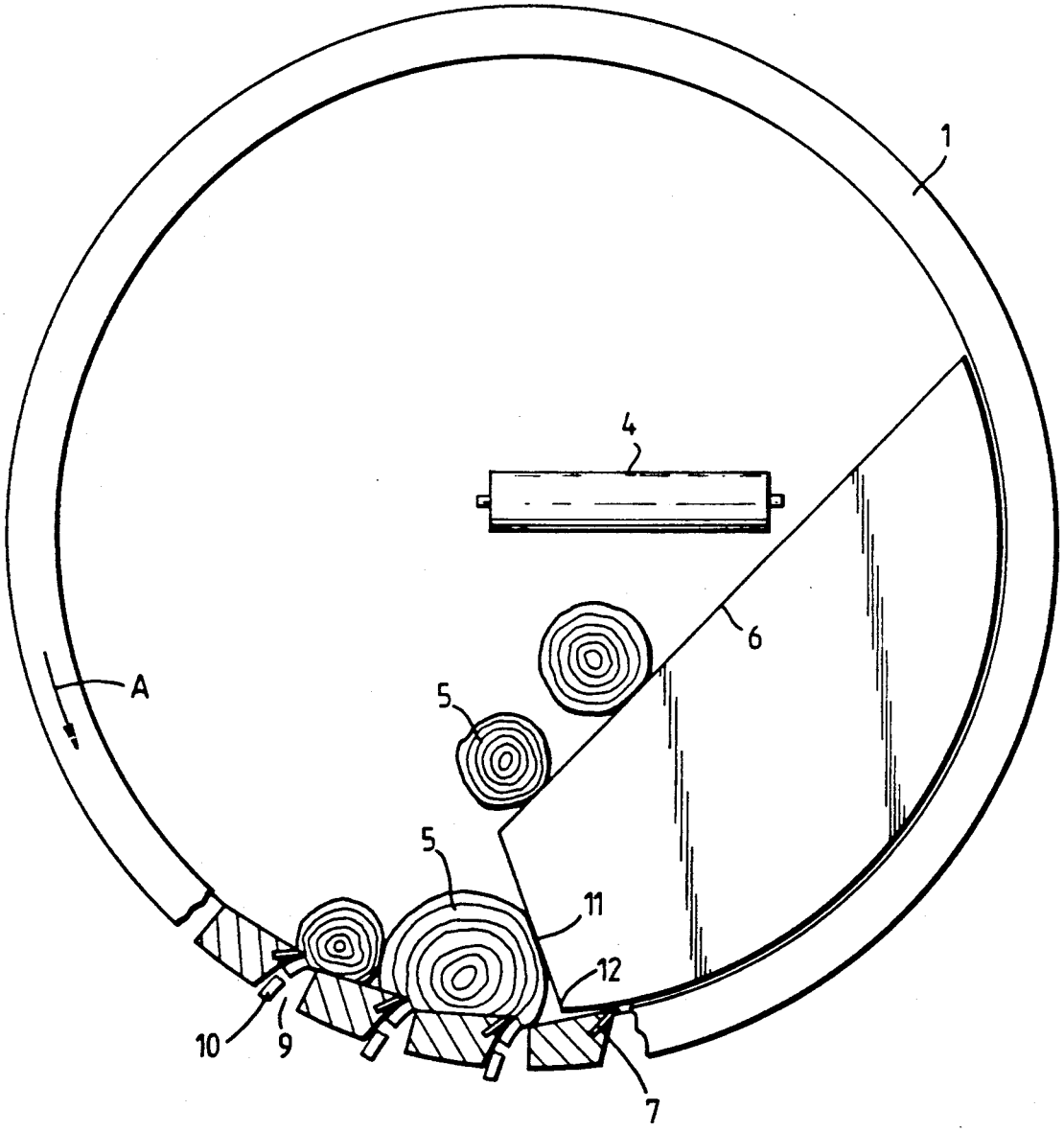
Figure 4:
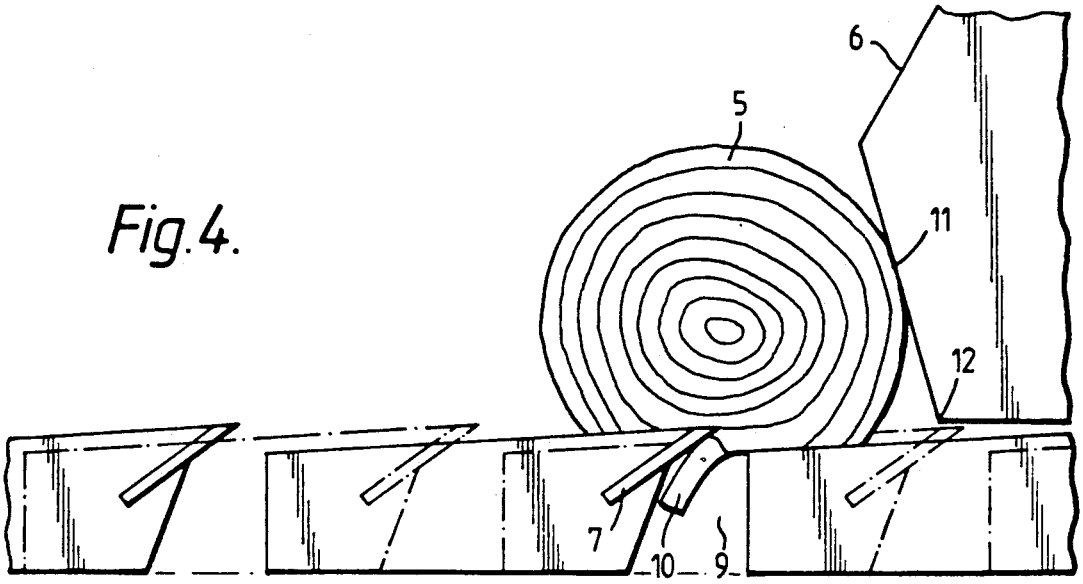
Figure 5A:
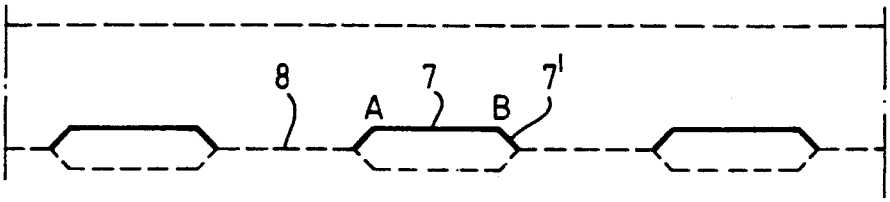
Figure 5B:
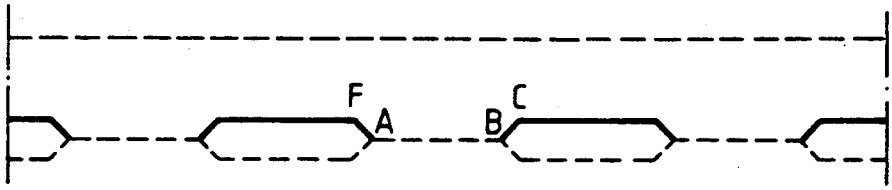
Figure 5C:
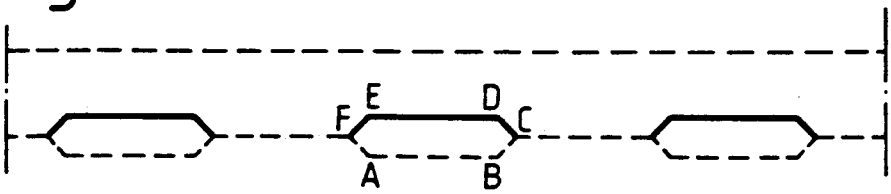

The invention and its details will be described more closely in the following referring to the accompanying drawings, whereby FIG. 1 is a side view and in section of the chipping device according to the invention, FIG. 2 is a cross profile of the device, FIG. 3 is a top view and in section of the same, FIG. 4 is a part of the FIG. 2 in enlarged scale when sequential cutting blades are shown for the sake of clarity on overlapping levels and FIG. 5*a*–5*c* are side views of sequential cutting blades (without the cylinder) and showing phases of chip formation.

The cylinder 1 is supported by bearings 2 and it rotates around a horizontal axle according to the arrow A. Drive is obtained by the motor 3. A band conveyor 4 leads to the feeding end of the cylinder in the direction shown by the arrow B, the band conveyor feeding the wood to be chipped 5 longitudinally into the cylinder.

Under the conveyor, inside of the cylinder, there is a solid bevel delta 6 extending over the whole length of the cylinder, the delta 6 being inclined in a manner, that its one end is lower than the other and along of which the wood roll down to the bottom of the cylinder.

The inside of the cylinder is equipped with cutting blades 7, which are located in a distance from each other several blades sequently in each range of blades. There are several of these ranges of blades located parallel with the cylinder axle on the entire circle of the cylinder. Blades of the parallel ranges of blades are located overlapping each other in a manner, that in two parallel ranges of blades there is always on the spot of each blade a bladeless spot 8 between the two sequential blades of the next range of blades. Before the blades 7 there are openings 9 in the cylinder surface, through which the cut chips 10 can fall outside of the cylinder.

The bevel delta 6 extends downwards as a stop face 11. Between the cross profile of the stop face and the cylinder circle develops an angle of 90° or less and the bottom of the stop face forms a counter blade 12 for the cutting blades 7.

In longitudinal direction the direction of stop surface 11 and counter blade 12 differs from the direction of cylinder axle thus forming an acute angle with the ranges of blades when seen from top (FIG. 3). The inclined counter blade 12 corresponding the cylinder surface is as a matter of fact slightly convex thus being an ellipse.

When the cylinder rotates in the direction shown by the arrow A, the blades 7 cut chips from the wood 5 and the stop face 11 directs the wood in to inclined position. The wood being in inclined position inside the cylinder is at first free in its middle from the inside of the cylinder and the chipping begins from the ends of the wood, until the cut side of the wood corresponds the shape of the counter blade 12. In the inclined position the wood, however, is in contact with at least two blades 7 in different ranges of blades all the time and the wood is held in its position continuously by the blades supported by the stop face 11.

In the FIG. 4 and 5*a*–5*c* there is shown the formation of the chip. The FIG. 5*a*–5*c* show cutting blades in sequential ranges of blades and thus in sequential cutting phases as side view from the side of the cylinder. In each blade there is not only the actual longitudinal blade part 7, but also the end parts 7'. Most conveniently the end parts form an obtuse angle with the longitudinal blade part, whereby the cross profile of the chip formed hereby is hexagonal and there are no sharp edges in the chip at all.

After the blades of the parallel ranges of blades are located overlapping each other, the cutting of each chip of the wood proceeds in three sequential phases.

I. When cutting the former parallel chip from the wood the first longitudinal side A-B of the next chip is cut simultaneously (FIG. 5*a*).

II. In the next phase (FIG. 5*b*) a half of both ends of this chip is cut, i.e. parts A-F and B-C, simultaneously two other chips connected to the ends of this chip are cut.

III. At the end the part F-E-D-C is cut and the chip removes from the wood (FIG. 5*c*).

When all the angles in the cross profile of the chip can be formed to be in 90° angle or more, sharp edges can be avoided, which could easily break into pins and further into sawdust. When using overlapping blades high speeds and high cutting forces can be avoided entirely during the cutting procedure.

The invention is not limited only to the embodiment described above, but it can vary in different manners within the range of the claims. The angle between the parts 7 and 7' can be not only obtuse, but also right angle, whereby the cross profile of the chip is orthogon.

The stop face 11 and the counter blade 12 can also be located parallel with the cylinder axle, if the direction of the blades 7 and the ranges of blades on the other hand differs from the direction of the cylinder axle.

We claim:

1. A method for cutting chips of elongated pieces of wood comprising the steps of:

transporting a piece of wood into the interior of a rotary cylinder, said rotating cylinder having a plurality of blade rows, each blade row extending along a length of said rotating cylinder, and each blade row having a plurality of blades;

directing said piece of wood into said rotating cylinder such that said piece of wood is positioned in said cylinder at an acute angle with respect to said blade rows; and maintaining said piece of wood in contact with at least two blades wherein each of said at least two blades is disposed in a different blade row such that said piece of wood is secured in position.

2. An apparatus for cutting chips from a piece of wood comprising:

a rotatable cylinder having a plurality of blade rows extending along a length of said rotatable cylinder;

each blade row having a plurality of blades;

a stop face surface means for supporting said piece of wood during cutting of said chips;

said stop face means being disposed inside said rotatable cylinder and extending along a longitudinal axis of said rotatable cylinder at an acute angle to each of said plurality of blade rows.

3. An apparatus for cutting chips as set forth in claim 2, wherein said stop face means is disposed in a bottom region of said rotatable cylinder.

4. An apparatus for cutting chips as set forth in claim 2, wherein said plurality of blade rows are disposed substantially parallel with an axis of said rotatable cylinder and wherein said stop face means has an edge extending substantially the length of said rotatable cylinder and facing an inner surface of said rotatable cylinder, said edge having an elliptically convex shape over said length of said rotatable cylinder.

5. An apparatus for cutting chips as set forth in claim 3, wherein said plurality of blade rows are disposed substantially parallel with an axis of said rotatable cylinder and wherein said stop face means has an edge extending substantially the length of said rotatable cylinder and facing an inner surface of said rotatable cylinder, said edge having an elliptically convex shape over said length of said rotatable cylinder.

* * * * *